US006488447B1

(12) United States Patent
Nish et al.

(10) Patent No.: US 6,488,447 B1
(45) Date of Patent: Dec. 3, 2002

(54) COMPOSITE BUOYANCY MODULE

(75) Inventors: Randall W. Nish, Provo, UT (US); Randy A. Jones, Park City, UT (US); Metin Karayaka, Houston, TX (US)

(73) Assignee: EDO Corporation, Salt Lake City, UT (US)

( * ) Notice: Subject to any disclaimer, the term of this patent is extended or adjusted under 35 U.S.C. 154(b) by 0 days.

(21) Appl. No.: 09/691,315

(22) Filed: Oct. 18, 2000

Related U.S. Application Data

(60) Provisional application No. 60/204,331, filed on May 15, 2000.

(51) Int. Cl.[7] ..... E21B 7/132; E21B 17/01

(52) U.S. Cl. ..... 405/224.2; 405/195.1; 405/205; 405/223.1; 114/264; 166/350; 166/367; 175/8

(58) Field of Search ..... 405/195.1, 204, 405/205, 211, 216, 223.1, 224, 224.1–224.4; 114/230, 243, 264, 265; 166/345, 350, 355, 359, 367; 175/7, 8

(56) References Cited

U.S. PATENT DOCUMENTS

| | | | | | |
|---|---|---|---|---|---|
| 3,470,838 | A | | 10/1969 | Daniell | |
| 4,078,605 | A | * | 3/1978 | Jones | 166/359 |
| 4,398,487 | A | * | 8/1983 | Ortloff et al. | 114/243 |
| 4,470,722 | A | * | 9/1984 | Gregory | 405/195.1 |
| 4,474,129 | A | * | 10/1984 | Watkins et al. | 114/243 |
| 4,604,961 | A | * | 8/1986 | Ortloff et al. | 114/230 |
| 4,606,673 | A | * | 8/1986 | Daniell | 405/210 |
| 4,616,707 | A | * | 10/1986 | Langner | 166/345 |
| 4,634,314 | A | * | 1/1987 | Pierce | 405/195.1 |
| 4,646,840 | A | * | 3/1987 | Bartholomew et al. | 166/350 |
| 4,702,321 | A | | 10/1987 | Horton | |
| 4,740,109 | A | * | 4/1988 | Horton | 405/224 |
| 4,821,804 | A | * | 4/1989 | Pierce | 166/367 |
| 5,330,924 | A | * | 7/1994 | Guesnon | 405/224.2 |
| 5,421,413 | A | * | 6/1995 | Allen et al. | 405/211 X |
| 5,431,511 | A | * | 7/1995 | Guy | 405/223.1 |
| 5,439,321 | A | * | 8/1995 | Hunter | 405/195.1 |
| 5,542,783 | A | * | 8/1996 | Pollack | 405/223.1 |
| 5,558,467 | A | | 9/1996 | Horton | |
| 5,651,709 | A | * | 7/1997 | Nandakumar et al. | 114/293 X |
| 5,823,131 | A | * | 10/1998 | Boatman et al. | 114/230 |
| 5,984,584 | A | * | 11/1999 | McMillan et al. | 405/195.1 |
| 6,067,922 | A | * | 5/2000 | Denison et al. | 114/243 |
| 6,092,483 | A | * | 7/2000 | Allen et al. | 114/264 |
| 6,161,620 | A | * | 12/2000 | Cox et al. | 166/367 |
| 6,179,524 | B1 | * | 1/2001 | Allen et al. | 405/211 |
| 6,213,045 | B1 | * | 4/2001 | Gaber | 114/266 |
| 6,227,131 | B1 | * | 5/2001 | Allen et al. | 114/264 |

FOREIGN PATENT DOCUMENTS

| | | | | |
|---|---|---|---|---|
| GB | 2069450 | * | 8/1981 | 166/359 |
| GB | 2133446 | * | 7/1984 | 405/210 |

* cited by examiner

*Primary Examiner*—Jong-Suk (James) Lee
(74) *Attorney, Agent, or Firm*—Thorpe North & Western

(57) ABSTRACT

A buoyancy system for a deep water floating platform includes at least one composite buoyancy module coupled to the a riser having a length greater than 1000 feet and an associated weight. The composite buoyancy module is sized to have a volume to produce a buoyancy force at least as great as the weight of the riser. The composite buoyancy module may include a vessel with a composite vessel wall. The buoyancy module or vessel may have a non-circular cross-section defining an area which is greater than approximately 79 percent of an area defined by a square with sides tangent to the vessel wall to maximize buoyancy. A second buoyancy module may be directly coupled to the first buoyancy module to achieve a desired buoyancy.

30 Claims, 7 Drawing Sheets

COMPOSITE BUOYANCY MODULE

This is a non-provisional patent application related to U.S. Provisional patent application Ser. No. 60/204,331 filed May 15, 2000 by inventors Randall W. Nish and Randy A. Jones.

BACKGROUND OF THE INVENTION

1. The Field of the Invention

The present invention relates generally to a composite buoyancy module or can for supporting a riser of a deep water, floating oil platform. More particularly, the present invention relates to a buoyancy module formed of composite material, and with a circular or non-circular cross-sectional shape to maximize buoyancy, or make optimum use of the space available.

2. The Background Art

As the cost of oil increases and/or the supply of readily accessible oil reserves are depleted, less productive or more distant oil reserves are targeted, and oil producers are pushed to greater extremes to extract oil from the less productive oil reserves, or to reach the more distant oil reserves. Such distant oil reserves may be located below the oceans, and oil producers have developed offshore drilling platforms in an effort to extend their reach to these oil reserves.

In addition, some oil reserves are located farther offshore, and thousands of feet below the surface of the oceans. Certain floating oil platforms, known as spars, or Deep Draft Caisson Vessels (DDCV) have been developed to. reach these oil reserves. Steel tubes or pipes, known as risers, are suspended from these floating platforms, and extend the thousands of feet to reach the ocean floor, and the oil reserves beyond.

It will be appreciated that these risers, formed of thousands of feet of steel pipe, have a substantial weight which must be supported by buoyant elements at the top of the risers. Steel air cans have been developed which are coupled to the risers and disposed in the water to help buoy the risers, and eliminate the strain on the floating platform, or associated rigging. One disadvantage with the air cans is that they are formed of metal, and thus add considerable weight themselves. Thus, the metal air cans must support the weight of the risers and themselves. In addition, the air cans are often built to pressure vessel specifications, and are thus costly and time consuming to manufacture.

In addition, as risers have become longer by going deeper, their weight has increased substantially. One solution to this problem has been to simply add additional air cans to the riser so that several air cans are attached in series. It will be appreciated that the diameter of the air cans is limited to the width of the well bays within the platform structure, while the length is merely limited by the practicality of handling the air cans. For example, the length of the air cans is limited by the ability or height of the crane that must lift and position the air can. One disadvantage with more and/or larger air cans is that the additional cans or larger size adds more and more weight which also be supported by the air cans, decreasing the air can's ability to support the risers. Another disadvantage with merely stringing a number air cans is that long strings of air cans may present structural problems themselves. For example, a number of air cans pushing upwards on one another, or on a stem pipe, may cause the cans or stem pipe to buckle.

SUMMARY OF THE INVENTION

It has been recognized that it would be advantageous to optimize the systems and processes of accessing distant oil reserves, such as deep water oil reserves. In addition, it has been recognized that it would be advantageous to develop a system for reducing the weight of air cans, and thus the riser system and platforms. In addition, it has been recognized that it would be advantageous to develop a system for increasing the buoyancy of the air cans.

The invention provides a modular buoyancy system including one or more buoyancy modules. The buoyancy modules are vertically oriented, disposed at and below the surface of the water and coupled to a riser or stem pipe to support the riser. The one or more buoyancy modules are sized to have a volume to produce a buoyancy force at least as great as the riser.

In accordance with one aspect of the present invention, the riser may be over 10,000 feet long with an associated weight, and the buoyancy module advantageously may include an elongated vessel with a composite vessel wall. Preferably, the composite vessel wall advantageously has a decrease in weight when submerged between approximately 25 to 75 percent; and more preferably a decrease in weight when submerged between approximately 40 to 60 percent. In addition, the composite vessel wall preferably has a density less than the density of the riser. Furthermore, the composite vessel wall preferably has a coefficient of thermal expansion less than a coefficient of thermal expansion of the riser; and may have a coefficient of thermal expansion between approximately $-4.4\times10^{-8}$ to $8.0\times10^{-6}$ in/in/° F. The composite vessel wall also may have a thermal conductivity less than a thermal conductivity of the riser.

In accordance with another aspect of the present invention, the buoyancy module may include a stem pipe which extends concentrically within the vessel, with an upper end of the vessel coupled to the stem pipe. The riser is received through the stem pipe. Alternatively, the buoyancy vessel or module may be coupled directly to the riser.

A spider structure may be attached to the vessel to position the stem pipe concentrically within the vessel. The spider structure may have an annular member with an aperture receiving the stem pipe therethrough, and a plurality of arms attached to and extending between the vessel and the annular member.

In accordance with another aspect of the present invention, the buoyancy module or vessel advantageously may have a noncircular cross section to maximize buoyancy. The buoyancy module may be disposed in a floating platform with a grid structure with at least one individual square compartment through which the buoyancy module or vessel is disposed. The square compartment has a cross-sectional area. The non-circular cross-section of the buoyancy module or vessel advantageously defines an area greater than approximately 79 percent of the cross-sectional area of the square compartment. Preferably, the cross-section of the buoyancy module of vessel advantageously includes a polygon, such as hexagon, with an area greater than approximately 86 percent of the square compartment, or an octagon.

In accordance with another aspect of the present invention, a bumper advantageously is disposed between the square compartment and the buoyancy module or vessel.

In accordance with another aspect of the present invention, more than one buoyancy modules advantageously may be limited to manageable sized but coupled together to achieve a desired buoyancy. A second elongate vessel may have an upper end directly attached to the lower end of the first elongate vessel. The first and second elongate vessels may have different lengths, and different volumes.

Additional features and advantages of the invention will be set forth in the detailed description which follows, taken in conjunction with the accompanying drawing, which together illustrate by way of example, the features of the invention.

DETAILED DESCRIPTION

Figure 1:
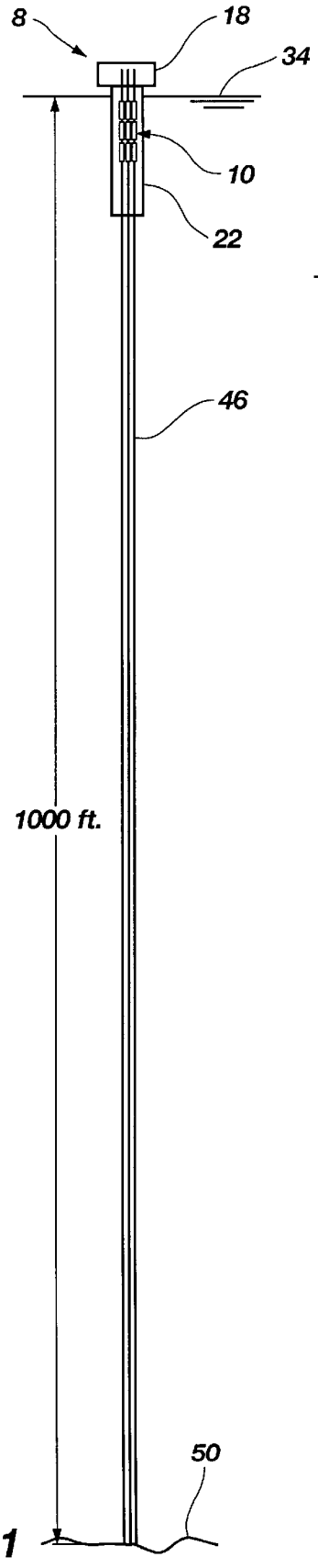
FIG. 1 is a schematic of a deep water, floating oil platform called a spar or Deep Draft Caisson Vessel with risers utilizing a modular buoyancy system in accordance with the present invention.

For the purposes of promoting an understanding of the principles of the invention, reference will now be made to the exemplary embodiments illustrated in the drawings, and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Figure 2:
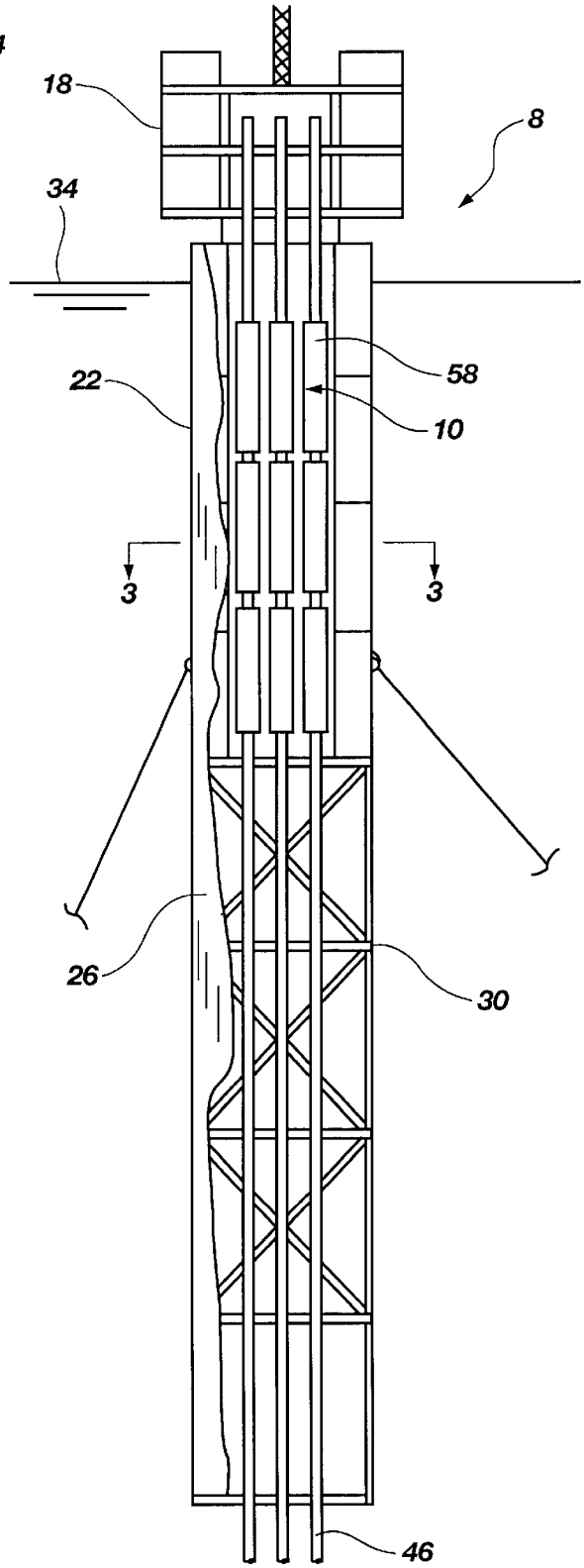
FIG. 2 is a partial, broken-away view of a preferred embodiment of the deep water, floating oil platform of FIG. 1 utilizing the modular buoyancy system in accordance with the present invention.

As illustrated in FIGS. 1 and 2, a deep water, floating oil platform, indicated generally at 8, is shown with a buoyancy system, indicated generally at 10, in accordance with the present invention. Deep water oil drilling and production is one example of a field which may benefit from use of such a buoyancy system 10. The term "deep water, floating oil platform" is used broadly herein to refer to buoyant platforms located above and below the surface, such as are utilized in drilling and/or production of fuels, such as oil and gas, typically located off-shore in the ocean at locations corresponding to depths of over several hundred or thousand feet, including classical, truss, and concrete spar-type platforms or Deep Draft Caisson Vessels, etc. Thus, the fuel, oil or gas reserves are located below the ocean floor at depths of over several hundred or thousand feet of water.

A classic, spar-type, floating platform 8 or Deep Draft Caisson Vessel (DDCV) is shown in FIGS. 1 and 2, and has both above-water, or topside, structure 18, and below-water, or submerged, structure 22. The above-water structure 18 includes several decks or levels which support operations such as drilling, production, etc., and thus may include associated equipment, such as a workover or drilling rig, production equipment, personnel support, etc. The submerged structure 22 may include a hull 26, which may be a full cylinder form. The hull 26 may include bulkheads, decks or levels, fixed and variable seawater ballasts, tanks, etc. The fuel, oil or gas may be stored in tanks in the hull. The platform 8, or hull, also has mooring fairleads to which mooring lines, such as chains or wires, are coupled to secure the platform or hull to an anchor in the sea floor.

The hull 26 also may include a truss or structure 30. The hull 26 and/or truss 30 may extend several hundred feet below the surface 34 of the water, such as 650 feet deep. A centerwell or moonpool 38 (See FIG. 3) is located in the hull 26. The buoyancy system 10 is located in the hull 26, truss 30, and/or centerwell 38. The centerwell 38 is typically flooded and contains compartments 42 (FIG. 3) or sections for separating the risers and the buoyancy system 10. The hull 26 provides buoyancy for the platform 8 while the centerwell 38 protects the risers and buoyancy system 10.

It is of course understood that the classic, spar-type or (DD CV), floating platform 8 depicted in FIGS. 1 and 2 is merely exemplary of the types of floating platforms which may be utilized. For example, other spar-type platforms may be used, such as truss spars, or concrete spars.

The buoyancy system 10 supports deep water risers 46 which extend from the floating platform 8, near the water surface 34, to the bottom 50 of the body of water, or ocean floor. The risers 46 are typically steel pipes or tubes with a hollow interior for conveying the fuel, oil or gas from the reserve, to the floating platform 8. The term "deep water risers" is used broadly herein to refer to pipes or tubes extending over several hundred or thousand feet between the reserve and the floating platform 8, including production risers, drilling risers, and export/import risers. The risers may extend to a surface platform or a submerged platform. The deep water risers 46 are coupled to the platform 8 by a thrust plate 54 (FIG. 4) located on the platform 8 such that the risers 46 are suspended from the thrust plate 54. In addition, the buoyancy system 10 is coupled to the thrust plate 54 such that the buoyancy system 10 supports the thrust plate 54, and thus the risers 46, as discussed in greater detail below.

Preferably, the buoyancy system 10 is utilized to access deep water reserves, or with deep water risers 46 which extend to extreme depths, such as over 1000 feet, more preferably over 3000 feet, and most preferably over 5000 feet. It will be appreciated that thousand feet lengths of steel pipe are exceptionally heavy, or have substantial weight. It also will be appreciated that steel pipe is thick or dense (i.e. approximately 0.283 lbs/in$^3$), and thus experiences relatively little change in weight when submerged in water, or seawater (i.e. approximately 0.037 lbs/in$^3$). Thus, for example, steel only experiences approximately a 13% decrease in weight when submerged. Therefore, thousands of feet of riser, or steel pipe, is essentially as heavy, even when submerged.

Figure 4:
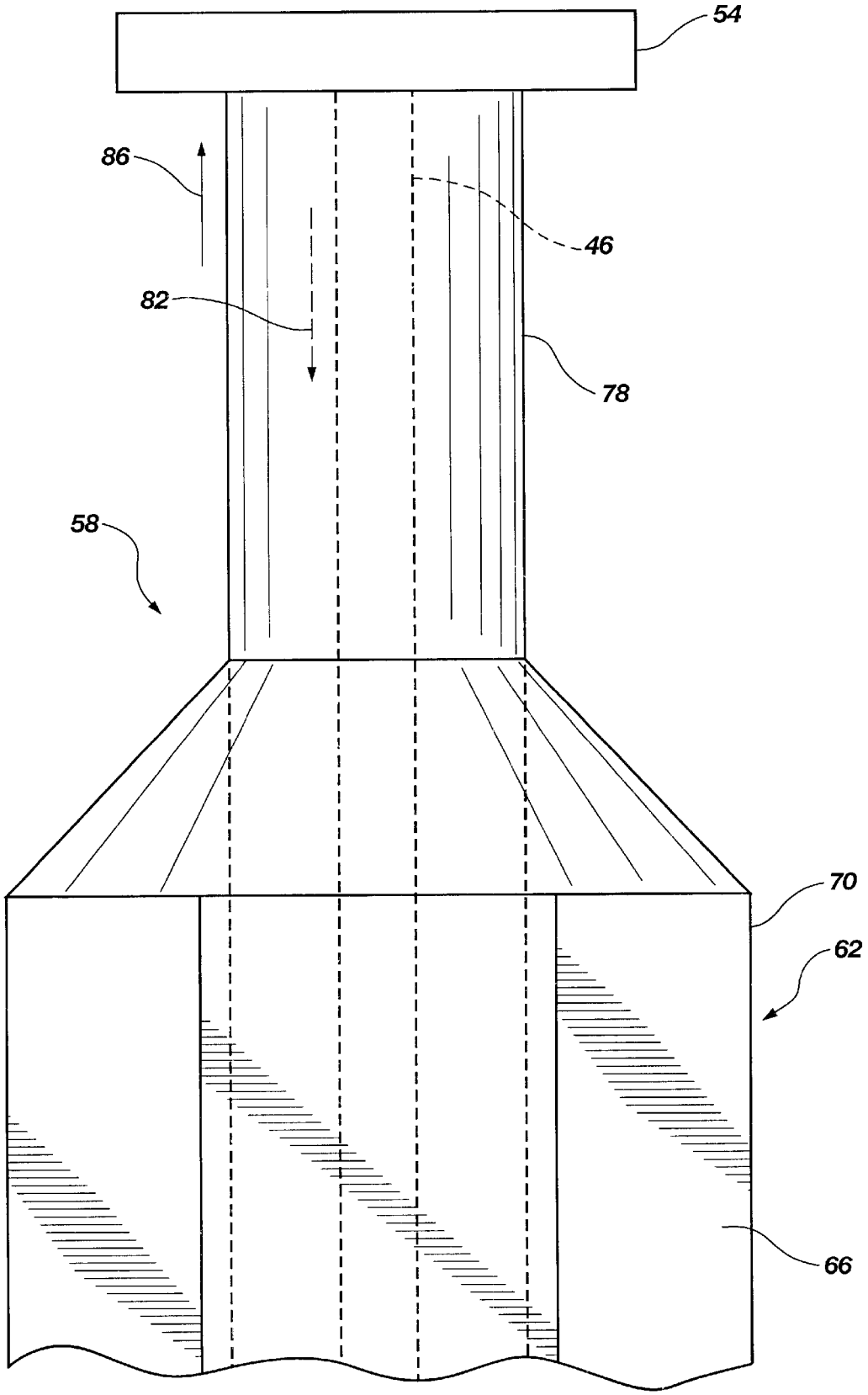
FIG. 4 is a partial side view of the modular buoyancy system in accordance with the present invention coupled to a stem pipe and riser.
Figure 5:
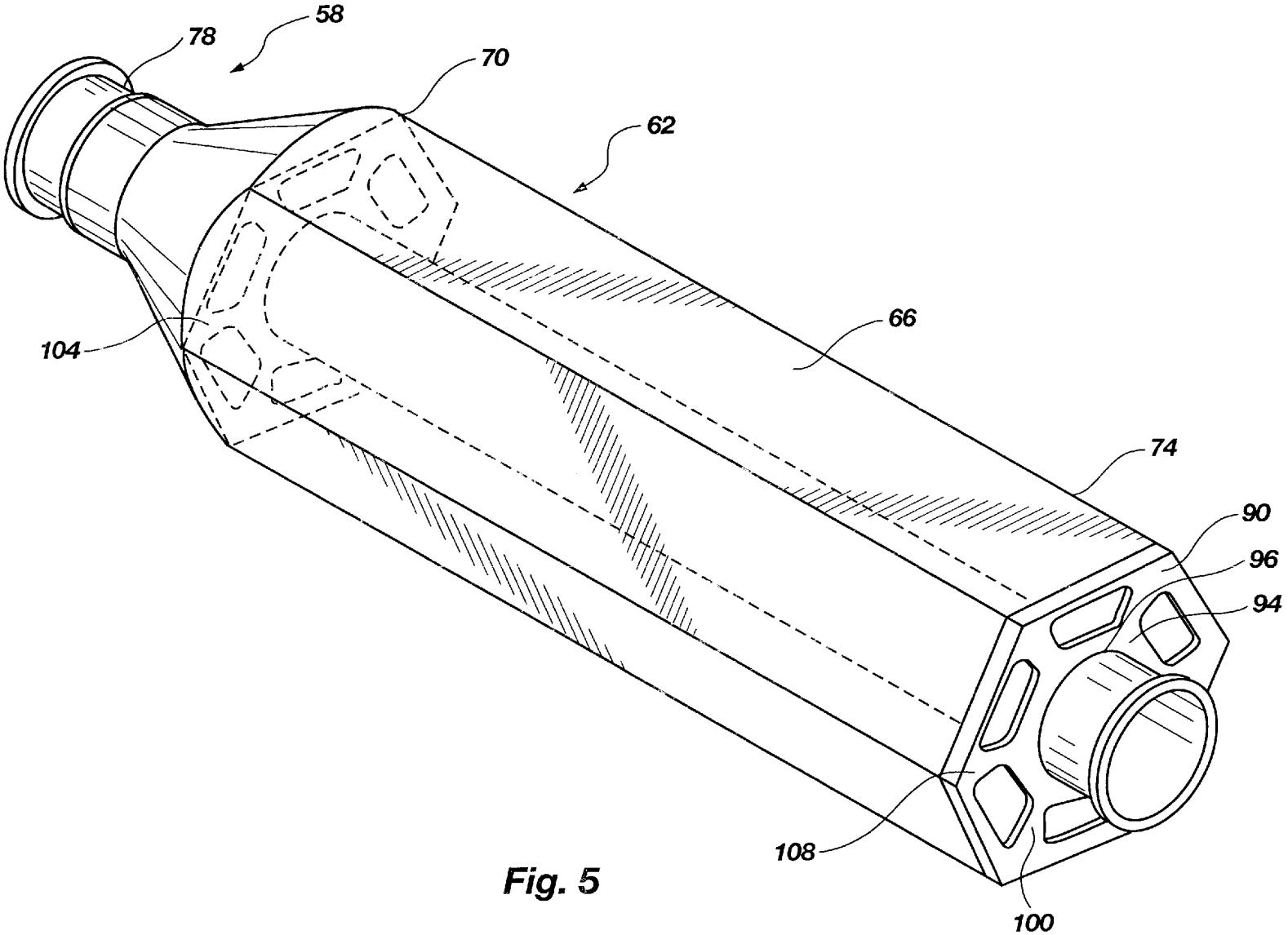
FIG. 5 is a perspective view of a composite buoyancy module in accordance with the present invention.

The buoyancy system 10 includes one or more buoyancy modules or vessels 58 which are submerged and filled with air to produce a buoyancy force to buoy or support the risers 46. Referring to FIG. 5, the buoyancy module 58 includes an elongate vessel 62 with a wall 66 or shell. The elongate vessel 62 is vertically oriented, submerged, and coupled to one or more risers 46 via the thrust plate 54 (FIG. 4). The vessel 62 has an upper end 70 and a lower end 74.

Figure 6:
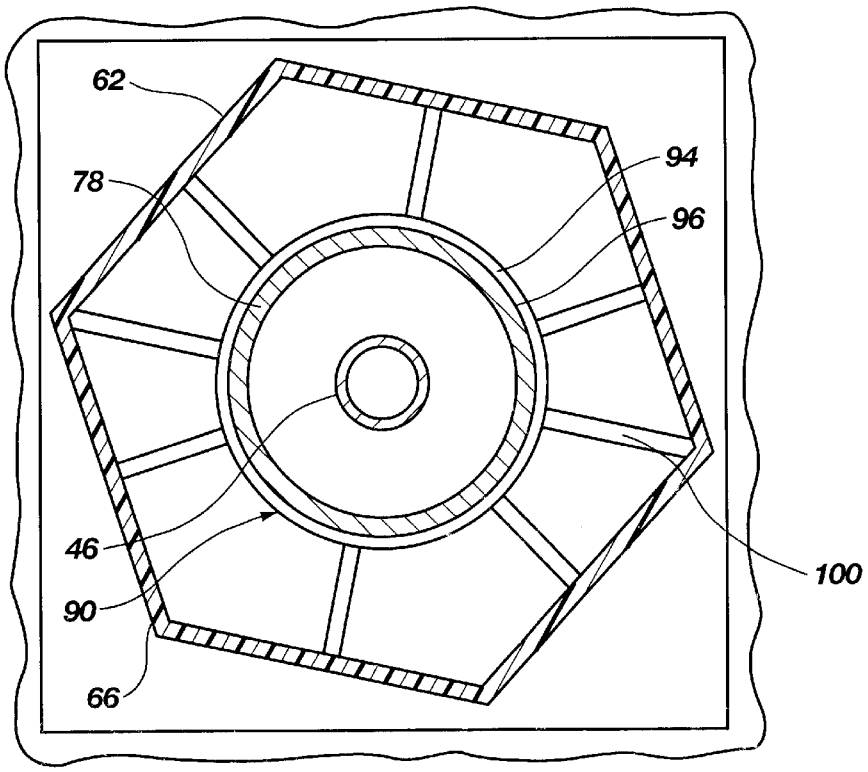
FIG. 6 is a cross-sectional view of the composite buoyancy system of FIG. 5.

In addition, the buoyancy module 58 may include a stem pipe 78 extending through the vessel 62 concentric with a longitudinal axis of the vessel 62. Preferably, the upper end 70 of the vessel 62 is coupled or attached to the stem pipe 78. As shown in FIG. 4, the stem pipe 78 may be directly coupled to the thrust plate 54 to couple the vessel 62 and buoyancy module 58 to the thrust plate 54, and thus to the riser 46. The stem pipe 78 may be sized to receive one or more risers 46 therethrough, as shown in FIG. 6.

Therefore, the risers 46 exert a downward force, indicated by arrow 82 in FIG. 4, due to their weight on the thrust plate 54, while the buoyancy module 58 or vessel 62 exerts an upward force, indicated by arrow 86 in FIG. 4, on the thrust plate 54. Preferably, the upward force 86 exerted by the one or more buoyancy modules 58 is equal to or greater than the downward force 82 due to the weight of the risers 46, so that the risers 46 do not pull on the platform 8 or rigging.

As stated above, the thousands of feet of risers 46 exert a substantial downward force 82 on the buoyancy system 10 or buoyancy module 58. It will be appreciated that the deeper the targeted reserve, or as drilling and/or production moves from hundreds of feet to several thousands of feet, the risers 46 will become exceedingly more heavy, and more and more buoyancy force 86 will be required to support the risers 46. It has been recognized that it would be advantageous to optimize the systems and processes for accessing deep reserves, to reduce the weight of the risers and platforms, and increase the buoyance force. Referring again to FIG. 5, the vessel 62 advantageously is a composite vessel, and the vessel wall 66 advantageously is formed of a fiber reinforced resin. The composite vessel 62 or vessel wall 66 preferably has a density of approximately 0.072 $lbs/in^3$. Therefore, the composite vessel 62 is substantially lighter than prior art air cans. In addition, the composite vessel 62 or vessel wall 66 advantageously experiences a significant decrease in weight, or greater decrease than metal or steel, when submerged. Preferably, the composite vessel 62 experiences a decrease in weight when submerged between approximately 25 to 75 percent, and most preferably between approximately 40 to 60 percent. Thus, the composite vessel 62 experiences a decrease in weight when submerged greater than three times that of steel.

The one or more buoyancy modules 58, or vessels 62, preferably have a volume sized to provide a buoyancy force 86 at least as great as the weight of the submerged riser 46. It will also be appreciated that motion of the floating platform 8, water motion, vibration of the floating platform 8 and associated equipment, etc., may cause the risers 46 to vibrate or move. Thus, the buoyancy modules 58 or vessels 62 more preferably have a volume sized to provide a buoyancy force at least approximately 20 percent greater than the weight of the submerged risers 46 in order to pull the risers 46 straight and tight to avoid harmonics, vibrations, and/or excess motion.

Referring to FIGS. 5 and 6, the buoyancy module 58 may include one or more spider structures 90 disposed at locations along the length thereof to support the vessel 62 and/or reinforce the structure and alignment of the vessel 62 and stem pipe 78. The spider structure 90 may be attached to the vessel 62 and include an annular member 94 with an aperture 96 through which the stem pipe 78 is received. A plurality of arms 100 may be attached to and between the vessel 62 and the annular member 94. The buoyancy module 58 may include an upper spider structure 104 located at the top thereof, and a lower spider structure 108 located at the bottom thereof, as shown in FIG. 5. In addition, intermediate spider structures also may be provided.

The stem pipe 78 may be formed of a metal, such as steel or aluminum. The vessel 62, however, preferably is formed of a composite material. Thus, the materials of the stem pipe 78 and vessel 62 may have different properties, such as coefficients of thermal expansion. The composite material of the vessel 62 may have a coefficient of thermal expansion much lower than that of the stem pipe 78 and/or risers 48. Therefore, the stem pipe 78 is axially movable disposed within the aperture 96 of the spider structure 90, and thus axially movable with respect to the vessel 62. Thus, as the stem pipe 78 and vessel 62 expand and contract, they may do so in the axial direction with respect to one another. For example, the composite material of the vessel 62 may have a coefficient of thermal expansion between approximately 4.0 to $8.0\times10^{-6}$ in/in/° F. for fiberglass reinforcement with epoxy, vinyl ester or polyester resin; or of $-4.4\times10^{-8}$ to $2.5\times10^{-6}$ in/in/° F. for carbon fiber reinforcement with epoxy, vinyl ester or polyester resin. In comparison, steel has a coefficient of thermal expansion between 6.0 to $7.0\times10^{-6}$ in/in/° F.; while aluminum has a coefficient of thermal expansion between 12.5 to $13.0\times10^{-6}$ in/in/° F. Thus, the composite vessel 62 advantageously has a much smaller coefficient of thermal expansion than the stem pipe 78, and experiences a smaller expansion or contraction with temperature changes.

Referring again to FIGS. 3 and 6, the floating platform 8 of hull 26 may include a centerwell 38 with a grid structure 112 with one or more square compartments 42, as described above. The risers 46 and buoyancy modules 58 are disposed in the compartments 42 and separated from one another by the grid structure 112. The compartments 42 may have a square cross-section with a cross-sectional area. The buoyancy module 58 and/or vessel 62 advantageously has a non-circular cross-section with a cross-sectional area greater than approximately 79 percent of the cross-sectional area of the compartment 42. Thus, the cross-sectional area, and thus the size, of the buoyancy module 58 and vessel 62 are designed to maximize the volume and buoyancy force 86 of the buoyancy module 58.

Figure 7:
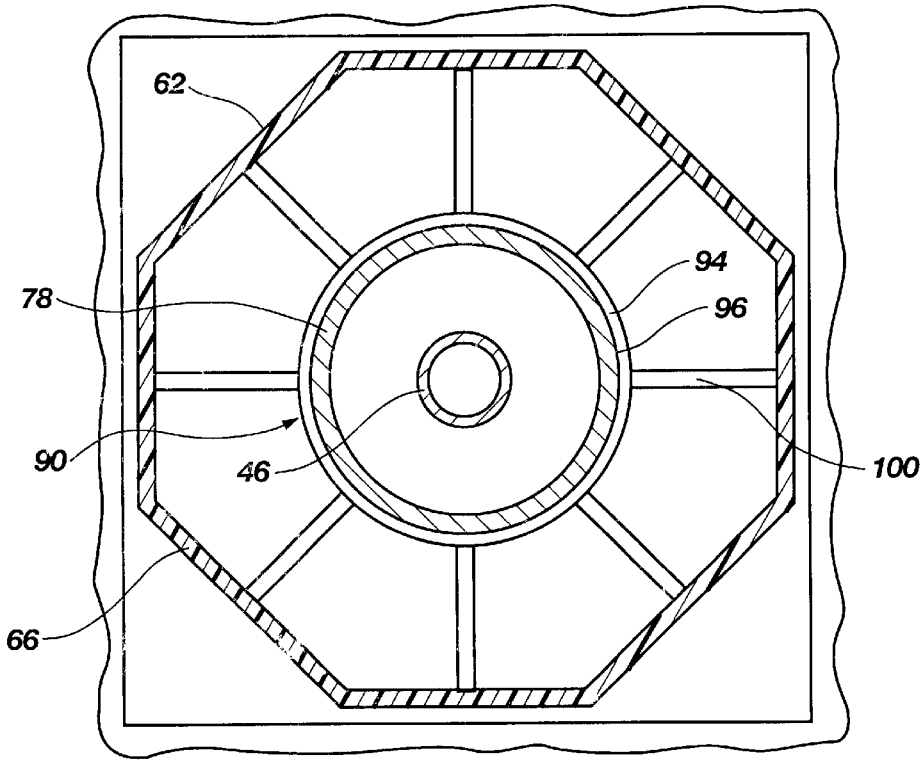
FIG. 7 is a cross-sectional view of a composite buoyancy system in accordance with the present invention.

Preferably, the buoyancy module 58 and vessel 62 may have an octagonal cross-sectional shape, and a cross-sectional area greater than approximately 79% of the cross-sectional area of the compartment 42, as shown in FIG. 7. Alternatively, the buoyancy module 58 and vessel 62 have a hexagonal cross-sectional shape, and a cross-sectional area greater than approximately 86 percent of the cross-sectional area of the compartment 42, as shown in FIGS. 5 and 6. It is of course understood that the buoyancy module 58 and vessel 62 may be any non-circular or polygonal shape to increase buoyancy.

Figure 3:
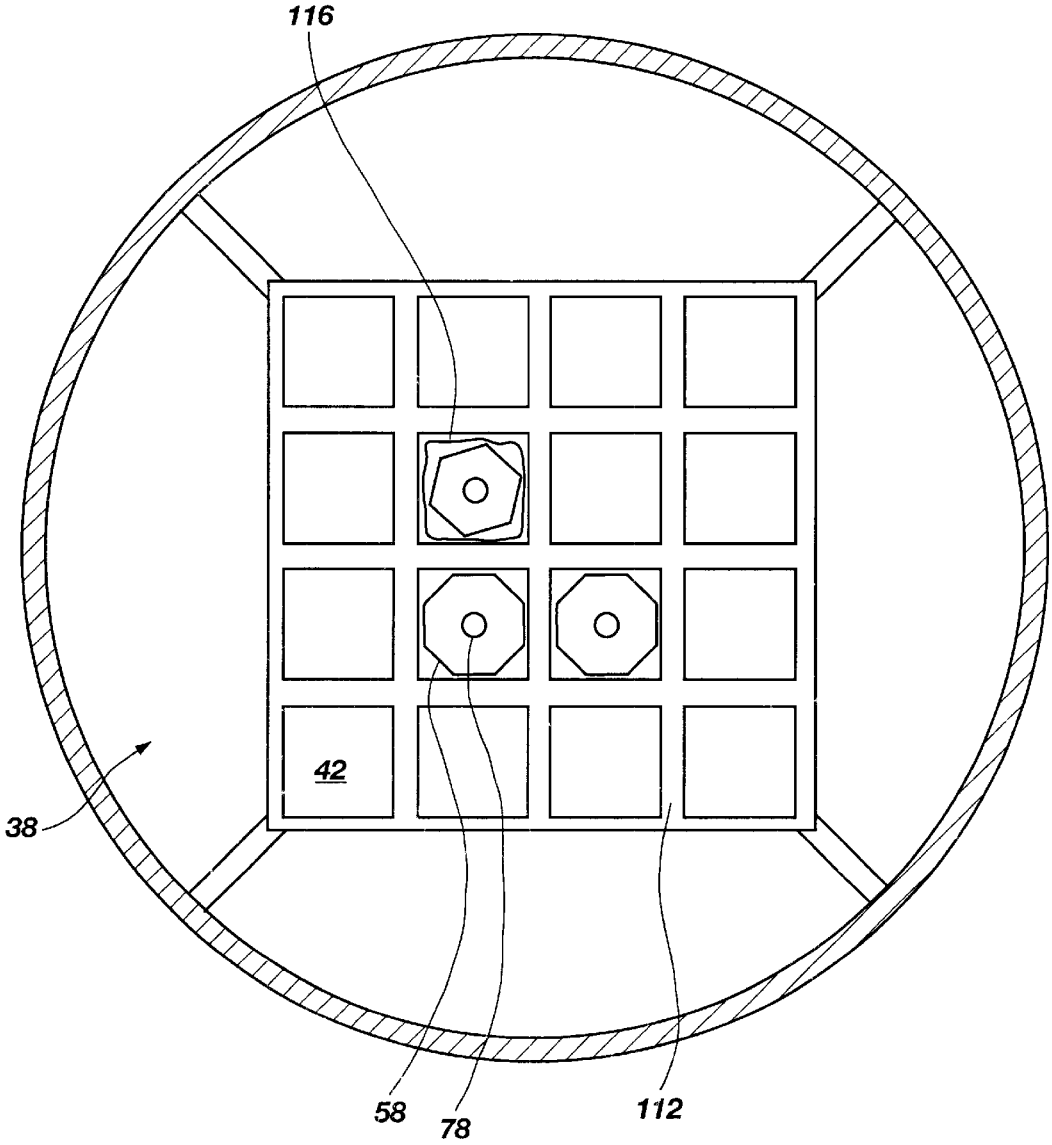
FIG. 3 is a cross-sectional view of the deep water, floating oil platform of FIG. 2 taken along line 3—3 utilizing the modular buoyancy system in accordance with the present invention.

Referring to FIG. 3, a bumper 116 may be disposed between the grid structure 112 and buoyancy module 58 to protect the buoyancy module 58 from damage as it moves within the compartment 42. The bumper 116 may be form of a flexible and/or resilient material to cushion impact or wear contact between the buoyancy module 58 and grid structure 112 as the buoyancy module 58 is installed.

Figure 8:
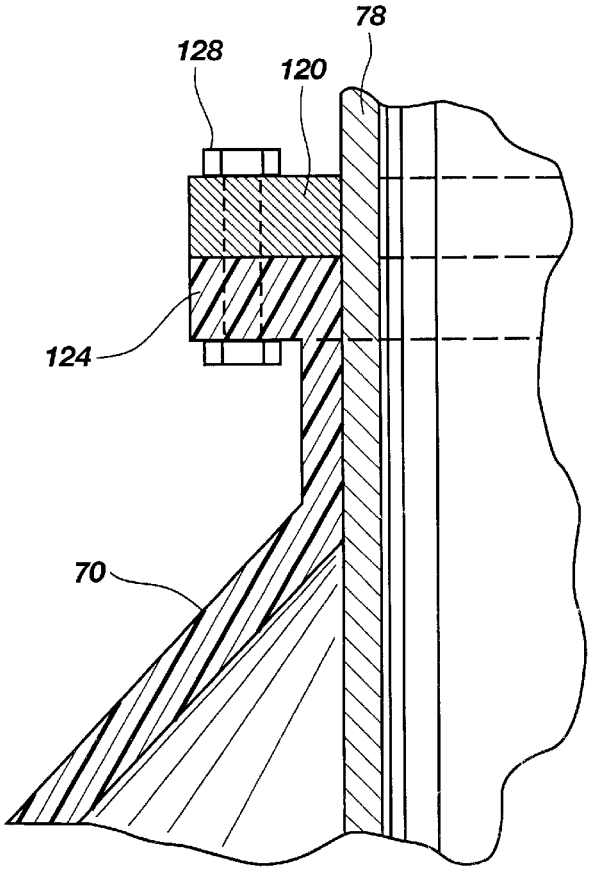
FIG. 8 is a partial cross-sectional view a top end of the modular buoyancy module of FIG. 5.

As stated above, preferably only the top end 70 of the vessel 62 is attached to the stem pipe 78. Referring to FIG. 8, an annular flange 120 may be attached to the stem pipe 78. The upper end 70 of the vessel 62 may taper conically to surround the stem pipe 78, and be provided with an annular flange 124 which abuts the annular flange 120 of the stem pipe 78. The annular flange 124 may be integrally formed with the vessel 62, or a separate piece attached to the vessel 62. The vessel 62 may be attached to the stem pipe 78 by attaching the two flanges 120 and 124 such as by bolts 128, rivets, etc. Alternatively, the two may be adhered.

Figure 9:
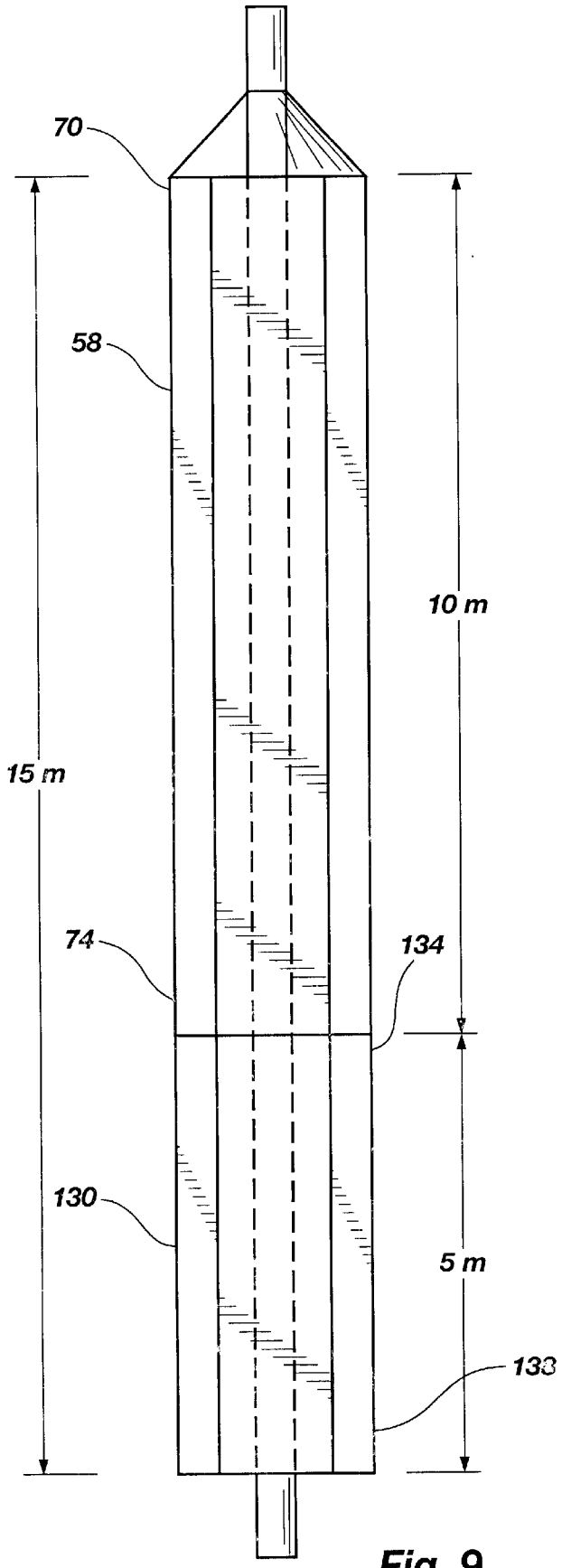
FIG. 9 is a side view of a pair of modular buoyancy modules in accordance with the present invention.

The buoyancy module 58 or vessel 62 preferably has a diameter or width of approximately 3 to 4 meters, and a length of approximately 10 to 20 meters. The diameter or width of the buoyancy modules 58 is limited by the size or width of the compartments 42 of the centerwell 38 or grid structure 112, while the length is limited to a size that is practical to handle. Referring to FIG. 9, the buoyancy system 10 advantageously may be modular, and include more than one buoyancy modules to obtain the desired volume, or buoyancy force, while maintaining each individual module at manageable lengths. For example, a first or upper buoyancy module 58 may be provided substantially as described above, while a second or lower buoyancy module 130 may be attached to the first to obtain the desired volume. The second buoyancy module 130 has upper and lower ends 134 and 138, with the upper end 134 of the second module 130 attached to the lower end 74 of the first module 58.

For example, the first module 58 may be 10 meters long, while the second module 130 is 5 meters long to obtain a combined length of 15 meters and desired buoyancy force. It will be appreciated that the buoyancy modules 58 and 130 may be provided in manageable sizes for transportation and handling, and assembled when convenient, such as on site, to achieve the desired buoyancy force based on the length of the risers 46.

Figure 10:
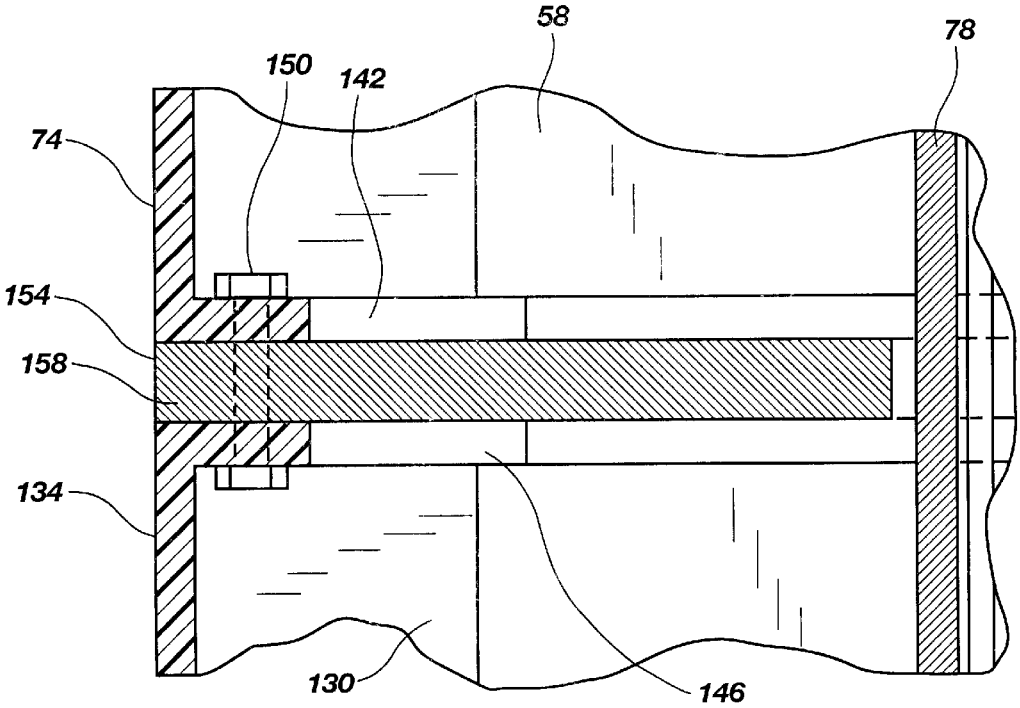
FIG. 10 is a partial cross-sectional view of the pair of modular buoyancy modules of FIG. 9.

Referring to FIG. 10, an annular flange 142 may be formed on the lower end 74 of the first or upper buoyancy module 58, and an annular flange 146 may be formed on the upper end 134 of the second or lower buoyancy module 130. The flanges 142 and 146 may be used to couple or attach the modules 58 and 130, such as with bolts 150, rivets, clamps, etc.

In addition, another spider structure or wagon wheel structure 154 may be used to couple the two modules 58 and 130 together. The spider structure 154 may be similar to the spider structure 90 described above. In addition, the spider structure 154 may include an outer annular member 158 which is located between the two modules 58 and 130 to form a seal.

It will be noted that the vessel 62 of the buoyancy module 58 described above may be attached directly to the riser 46, rather than the stem pipe 78.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been shown in the drawings and fully described above with particularity and detail in connection with what is presently deemed to be the most practical and preferred embodiment(s) of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A buoyancy system, comprising:

a riser, configured to extend vertically substantially between an ocean surface and an ocean floor, and having a length greater than 1000 feet and a weight;

at least one composite buoyancy module, coupled to the riser, configured to be disposed below the ocean surface and filled with air, and having a volume sized to produce a buoyancy force at least as great as the weight of the riser; and a floating or submerged platform, in which the composite buoyancy module and a portion of the riser are movably disposed, and having a grid structure with at least one individual square compartment through which the composite buoyancy module is disposed, the square compartment having a cross-sectional area; and the composite buoyancy module having a non-circular cross-section defining an area greater than approximately 79 percent of the cross-sectional area of the square compartment.

2. A buoyancy system in accordance with claim 1, wherein the composite buoyancy module includes a vessel with a composite vessel wall.

3. A buoyancy system in accordance with claim 2, wherein the composite vessel wall has a decrease in weight when submerged between approximately 25 to 75 percent.

4. A buoyancy system in accordance with claim 2, wherein the composite vessel wall has a decrease in weight when submerged between approximately 40 to 60 percent.

5. A buoyancy system in accordance with claim 2, wherein the composite vessel wall has a density less than a density of the riser.

6. A buoyancy system in accordance with claim 2, further comprising:

a stem pipe, extending concentrically within the vessel and coupled to an upper end of the vessel, and receiving the riser therethrough; and a spider structure, attached to the vessel, having an annular member with an aperture receiving the stem pipe therethrough, and a plurality of arms attached to and extending between the vessel and the annular member to position the stem pipe concentrically within the vessel.

7. A buoyancy system in accordance with claim 2, wherein the composite vessel wall has a coefficient of thermal expansion less than a coefficient of thermal expansion of the riser.

8. A buoyancy system in accordance with claim 2, wherein the composite vessel wall has a coefficient of thermal expansion between approximately $-4.4\times10-8$ to $8.0\times10^{-6}$ in/in/° F.

9. A buoyancy system in accordance with claim 2, wherein the composite vessel wall has a thermal conductivity less than a thermal conductivity of the riser.

10. A buoyancy system in accordance with claim 1, wherein the cross-section of the composite buoyancy module is a hexagon.

11. A buoyancy system in accordance with claim 1, wherein the cross-section of the composite buoyancy module has an area greater than approximately 86 percent of the square compartment.

12. A buoyancy system in accordance with claim 1, further comprising:

a bumper disposed between the square compartment and the buoyancy module.

13. A buoyancy system in accordance with claim 1, wherein the composite buoyancy module has a volume sized to produce a buoyancy force at least approximately 20 percent greater than the weight of the riser to pull the riser tight and straight to avoid harmonics.

14. A buoyancy module configured to be coupled to a deep water riser, comprising:

a) an elongate non-circular vessel having a substantially rigid vessel wall forming a non-circular cross-section, the non-circular vessel itself being pressurized with air; and b) a floating platform, in which the vessel is movably disposed, and having a grid structure with at least one individual square compartment through which the vessel is disposed, the square compartment having a cross-sectional area; and c) an area of the non-circular cross-section of the vessel being greater than approximately 79 percent of the cross sectional area of the square compartment.

15. A buoyancy module in accordance with claim 14, wherein the vessel has a polygonal cross-section.

16. A buoyancy module in accordance with claim 14, wherein the cross-section of the vessel is a hexagon.

17. A buoyancy module in accordance with claim 16, wherein the cross-section of the vessel has an area greater than approximately 86 percent of the square with sides tangent to the vessel wall.

18. A buoyancy module in accordance with claim 14, further comprising:

a bumper disposed between the square compartment and the vessel.

19. A buoyancy module in accordance with claim 14, urther comprising:

a riser, configured to extend vertically substantially between an ocean surface and an ocean floor, and having a length greater than 1000 feet and a weight;

wherein the vessel is coupled to the riser and includes a vessel wall formed of a fiber composite material and a volume sized to produce a buoyancy force at least as great as the weight of the riser.

20. A buoyancy module in accordance with claim 19, wherein the vessel has a volume sized to produce a buoyancy force at least approximately 20 percent greater than the weight of the riser to pull the riser tight and straight to avoid harmonics.

21. A buoyancy module in accordance with claim 14, wherein the vessel includes a vessel wall formed of a fiber composite material and which has a decrease in weight when submerged between approximately 25 to 75 percent.

22. A buoyancy module in accordance with claim 14, wherein the vessel includes a vessel wall formed of a fiber composite material and which has a decrease in weight when submerged between approximately 40 to 60 percent.

23. A buoyancy module in accordance with claim 14, further comprising:

a stem pipe, extending concentrically within the vessel and coupled to an upper end of the vessel, and receiving the riser therethrough; and a spider structure, attached to the vessel, having an annular member with an aperture receiving the stem pipe therethrough, and a plurality of arms attached to and extending between the vessel and the annular member to position the stem pipe concentrically within the vessel.

24. A buoyancy module in accordance with claim 14, wherein the vessel includes a vessel wall formed of a fiber composite material with a coefficient of thermal expansion between approximately $-4.4\times10^{-8}$ to $8.0\times10^{-6}$ in/in/EF.

25. A buoyancy module in accordance with claim 14, further comprising:

a first elongate vessel, configured to be submerged beneath a surface of water, vertically oriented, and coupled to the riser, and having an open lower end; and a second elongate vessel, capable of being independently transported and position with respect to the first elongate vessel and configured to be submerged beneath the surface of water and vertically oriented, and having an open upper end coupled to the open lower end of the first elongate vessel to collectively form a single, pressurized interior space.

26. A modular buoyancy system in accordance with claim 25, wherein the first and second elongate vessels have different lengths, and different volumes.

27. A buoyancy system, comprising:

a) a floating or submerged platform having a grid structure with at least one individual square compartment with a cross-sectional area;

b) a riser, coupled to the floating or submerged platform and extending through the square compartment;

c) an elongate vessel, disposed in the floating or submerged platform and the square compartment and coupled to the riser, having a vessel wall forming a non-circular cross-section; and d) the non-circular cross-section defining an area which is greater than approximately 79 percent of the cross sectional area of the square compartment.

28. A buoyancy system in accordance with claim 27, wherein:

a) the riser is configured to extend vertically substantially between an ocean surface and an ocean floor, and has a length greater than 1000 feet; and b) the vessel wall includes a fiber composite vessel wall that has a decrease in weight when submerged between approximately 25 to 75 percent.

29. A buoyancy system in accordance with claim 27, wherein the vessel wall has a polygonal cross-section.

30. A buoyancy system in accordance with claim 27, wherein the cross-section of the vessel wall is a hexagon.

* * * * *